US005605305A

United States Patent [19]

Picton

[11] Patent Number: 5,605,305

[45] Date of Patent: Feb. 25, 1997

[54] KNOCK-DOWN, RETURNABLE, HIGH LOAD CAPACITY PLASTIC CABLE REEL

[76] Inventor: Valentine L. Picton, 4897 Stoneybrook Rd., Vernon, N.Y. 13476

[21] Appl. No.: 408,697

[22] Filed: Mar. 21, 1995

Related U.S. Application Data

[63] Continuation-in-part of Ser. No. 95,942, Jul. 22, 1993, abandoned, which is a continuation-in-part of Ser. No. 979,303, Nov. 20, 1992, abandoned.

[51] Int. Cl.[6] ..... B65H 75/14; B65H 75/22

[52] U.S. Cl. ..... 242/608; 242/608.4; 242/610.6; 242/118.62; 242/118.7; 242/609.2; 242/613.4; 242/614

[58] Field of Search ..... 242/608.3, 608.4, 242/609.1, 609.2, 610.6, 613, 613.4, 118.6, 118.62, 118.7, 614, 326.3, 345, 376, 407, 407.1, 608

[56] References Cited

U.S. PATENT DOCUMENTS

| | | | |
|---|---|---|---|
| 1,767,710 | 6/1930 | Smith | 242/608.4 |
| 2,225,551 | 12/1940 | Clinton | 242/118.6 |
| 2,652,992 | 9/1953 | Tucker, Jr. | 242/118.6 |
| 3,160,362 | 12/1964 | Weber | 242/577 |
| 3,284,021 | 11/1966 | Ryll et al. | 242/608.3 |
| 3,940,085 | 2/1976 | Campbell | 242/609.2 |
| 4,066,224 | 1/1978 | Hargreaves et al. | 242/118.6 X |
| 4,422,595 | 12/1983 | Thomas | 242/608.4 |
| 4,624,421 | 11/1986 | Takeuchi | 242/608.3 |
| 5,143,316 | 9/1992 | Goetz et al. | 242/129.5 |

FOREIGN PATENT DOCUMENTS

| | | | |
|---|---|---|---|
| 3712680C1 | 10/1988 | Germany . | |
| 440878 | 1/1936 | United Kingdom | 242/115 |

OTHER PUBLICATIONS

PCT/CA94/00372 International Search Report, filed Jul. 21, 1994, Valentine L. Picton, Applicant, 7 pages.

*Primary Examiner*—John Q. Nguyen
*Attorney, Agent, or Firm*—Leonard Bloom

[57] ABSTRACT

A cable reel comprising a drum and side flanges molded of plastic is of sufficient size, strength and rigidity to carry loads in excess of 10,000 lbs. without significant distortion or flattening. The required strength and rigidity are achieved by molding the side flanges so that they tend to assume a dished configuration that is substantially flattened when the side flanges are bolted by tie-rods to the ends of the drum all of which prestresses the side flanges. The tie rods have threaded ends for receiving bolts that secure the side flanges to the drum and serve to reinforce the final structure. During curing of each reel component while it is still in the mold, shrinkage of the component is resisted so as to increase the strength of the component. The drum comprises at least two sections and the reel may be easily disassembled and the parts stacked for storage and shipment as a compact package. The reel components are preferably molded of recycled plastic comprising a mixture of high density and low density polyethylene derived from post-consumer plastic waste.

12 Claims, 14 Drawing Sheets

KNOCK-DOWN, RETURNABLE, HIGH LOAD CAPACITY PLASTIC CABLE REEL

CROSS REFERENCE TO RELATED APPLICATION

This application is a continuation-in-part of application Ser. No. 08/095,942 filed Jul. 22, 1993, abandoned, for "KNOCK-DOWN, RETURNABLE, HIGH LOAD CAPACITY PLASTIC CABLE REEL" which, in turn, is a continuation-in-part of application Ser. No. 07/979,303 filed Nov. 20, 1992 abandoned, for "KNOCK-DOWN, PLASTIC CABLE SPOOL" (now abandoned).

FIELD OF THE INVENTION

The present invention relates to reels for carrying industrial cable, wire rope, and the like, and more particularly to reels that are made of plastic and have a collapsible or knock-down construction.

BACKGROUND OF THE INVENTION

Electrical, communication and other industrial cable, as well as wire rope and the like are typically wound on large spools or reels for storage, delivery and dispensing of the product. Such reels may be intended to be returned to their point of origin, such as a cable manufacturer, after the product has been dispensed or they may be nonreturnable.

Existing returnable reels are usually fabricated of wood that has been treated with a preservative such as creosote, or painted, so as to resist weathering and deterioration. Reels made of steel are also known; these, too, are often painted or otherwise treated so as to provide protection against rusting. Wood and steel reels have several disadvantages. Most importantly, despite efforts to protect them from the elements they are subject to deterioration and therefore require constant maintenance. Wood reels, especially, are prone to splintering and breakage, and nails and bolts projecting from such reels pose a safety hazard and can damage the insulation of electrical or communication cable being carried. Moreover, wood reels soak up rain water, increasing their weight by as much as 50%. The dry weight marked on the reel is then meaningless making it impossible for the user to determine how much cable remains on the reel since this determination is usually made by weight.

Because of the space taken up by the reels, the return shipment of empty reels to the cable manufacturer or other point of origin is often highly inefficient, being limited to relatively few reels per truckload. This inefficiency and the attendant costs are particularly significant for long distance shipments. U.S. Pat. Nos. 1,767,710; 3,284,021; and 4,066,224 disclose examples of knock-down reels which may be disassembled and shipped or stored as compact packages.

Knock-down reels made of plastic are also known, as illustrated by the aforementioned U.S. Pat. No. 3,940,085. Plastic reels are substantially impervious to the elements and require little or no maintenance and do not damage the cable being carried. However, because of strength limitations, plastic reels of the prior art are limited in size and load capacity. For example, the aforementioned U.S. Pat. No. 3,940,085 specifies a flange diameter of up to 36 inches. Reels of such small size, however, typically have load capacities substantially less than 2,000 pounds. Existing plastic reels tend to distort under high loads, thereby reducing the uniformity of the windings of the product carried by the reel.

The longevity of prior art reels, regardless of the material used in their construction, is limited because they cannot withstand the rough handling to which reels of this kind are often subjected. For example, prior art reels are easily damaged when dropped from even modest heights, or as a result of other impact loads such as might be imposed by a moving forklift. Prior art high capacity reels (e.g., those having load capacities of 10,000 pounds) also exhibit limited resistance to distortion or flattening when stored in one position for an extended period.

The abuse to which reels are subjected means that many thousands of them must be replaced annually in the United States alone, contributing to inefficiency and waste of resources, especially forest products in the case of wood reels.

It is thus an overall object of the present invention to provide a reel that has superior strength and resistance to impact and distortion, yet is capable of carrying very high loads, for example, in excess of 10,000 pounds.

It is another object of the present invention to provide a high load capacity reel whose components are fabricated of molded plastic.

It is another object of the present invention to provide a high load capacity plastic reel for carrying industrial cable, wire rope or the like, and which has a knock-down construction facilitating compact storage and shipment.

It is yet another object of the present invention to provide a high load capacity plastic reel whose major components are all made of recycled plastic.

It is still another object of the present invention to provide methods for fabricating large, high load capacity, knock-down plastic reels, that have superior strength and resistance to impact and distortion.

SUMMARY OF THE INVENTION

In accordance with the present invention, there is provided a reel (hereinafter sometimes referred to as a "cable reel") for carrying and dispensing flexible stranded product such as industrial cable, wire rope, and the like, whose main components are fabricated of molded plastic yet are strong enough so that the reel is impact resistant and capable of carrying very high loads without significant distortion or flattening. A cable reel in accordance with the principles of the invention may, for example, have side flanges 6 feet or more in diameter and a rated load capacity of 10,000 pounds or more.

In accordance with one specific embodiment of the invention, there is provided a cable reel having a longitudinal central axis and a centre drum comprising at least two sections separable along longitudinally planar surfaces extending between the ends of the drum. A side flange is detachably secured to each end of the centre drum to provide a reel that can be quickly and easily disassembled and stacked in a compact package for storage and shipment. The main components of the reel, that is, the centre drum sections and side flanges, are molded of plastic and have sufficient size, strength and rigidity to carry the mentioned loads without significant distortion or flattening. The required strength and rigidity are attained by, among other things, designing and molding the main components especially the side flanges, in such a manner that they are prestressed sufficiently in the assembled reel as to enable them to carry the high loads noted above without significant distortion.

Preferably, cable reels in accordance with the invention are fabricated of 100% post-consumer plastic waste (for example, bags, film, milk containers and soft drink bottles) and may, in accordance with one example, consist of a mixture of high density and low density polyethylene. The use of recycled plastic helps meet the environmental regulations of a number of states, such as California, which encourage the use of recyclable materials by industry and which may require a certain percentage (for example, 10%) of the goods purchased by the state to be fabricated of such material.

Moreover, cable reels according to the present invention are ultraviolet stable and can be easily cleaned with water. No nails or other hazardous fastening devices project from any of the surfaces of the reel of the invention so that injury to operators and damage to the product being carried are virtually eliminated. Since plastic does not absorb water, the dry weight marked on the reel will not vary so as to provide at any time and under any weather conditions an accurate indication of the amount of cable remaining on the reel.

BRIEF DESCRIPTION OF THE DRAWINGS

Further objects, features and advantages of the invention will become evident from the detailed description below when read in conjunction with the accompanying drawings in which.

DETAILED DESCRIPTION OF THE PREFERRED EMBODIMENTS

Figure 1:
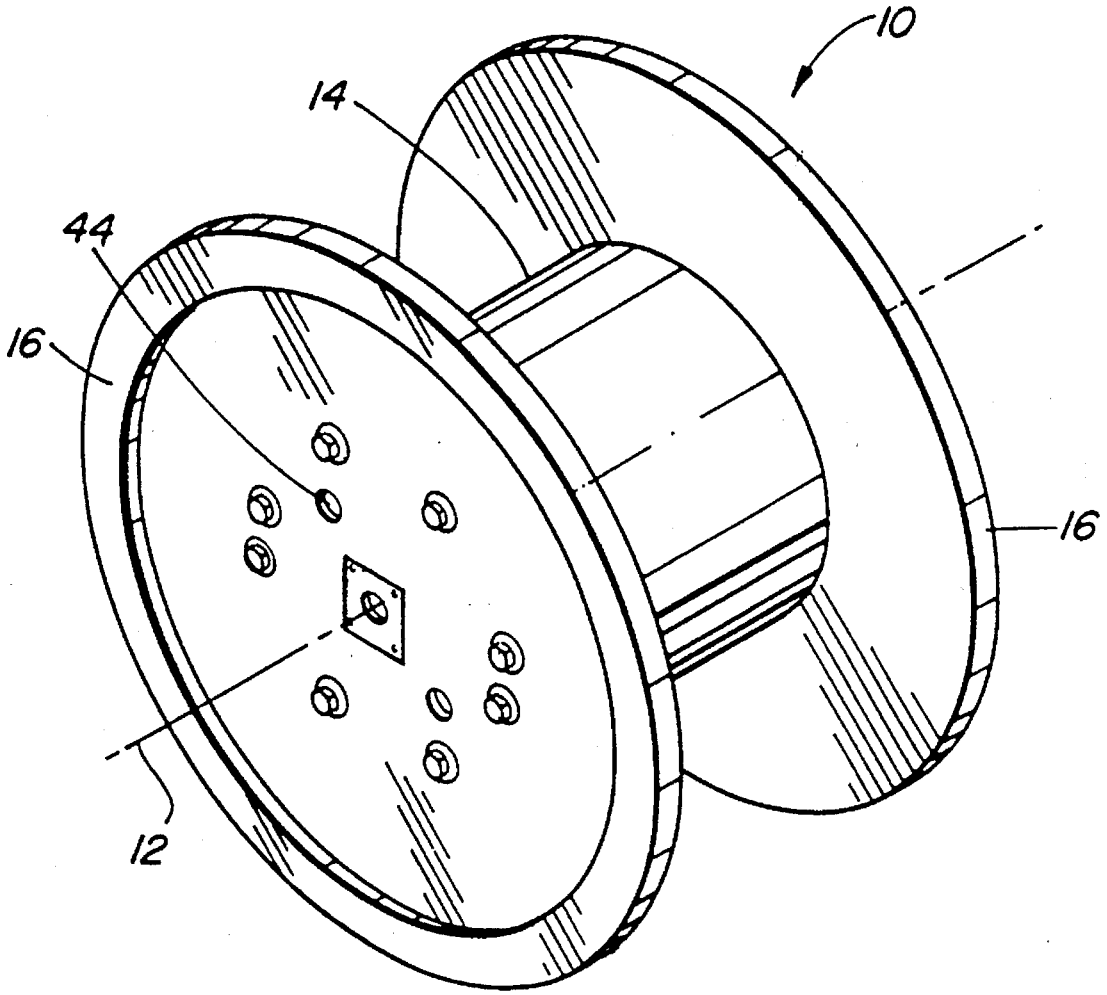
FIG. 1 is a perspective view of a cable reel in accordance with a first embodiment of the present invention.
Figure 2:
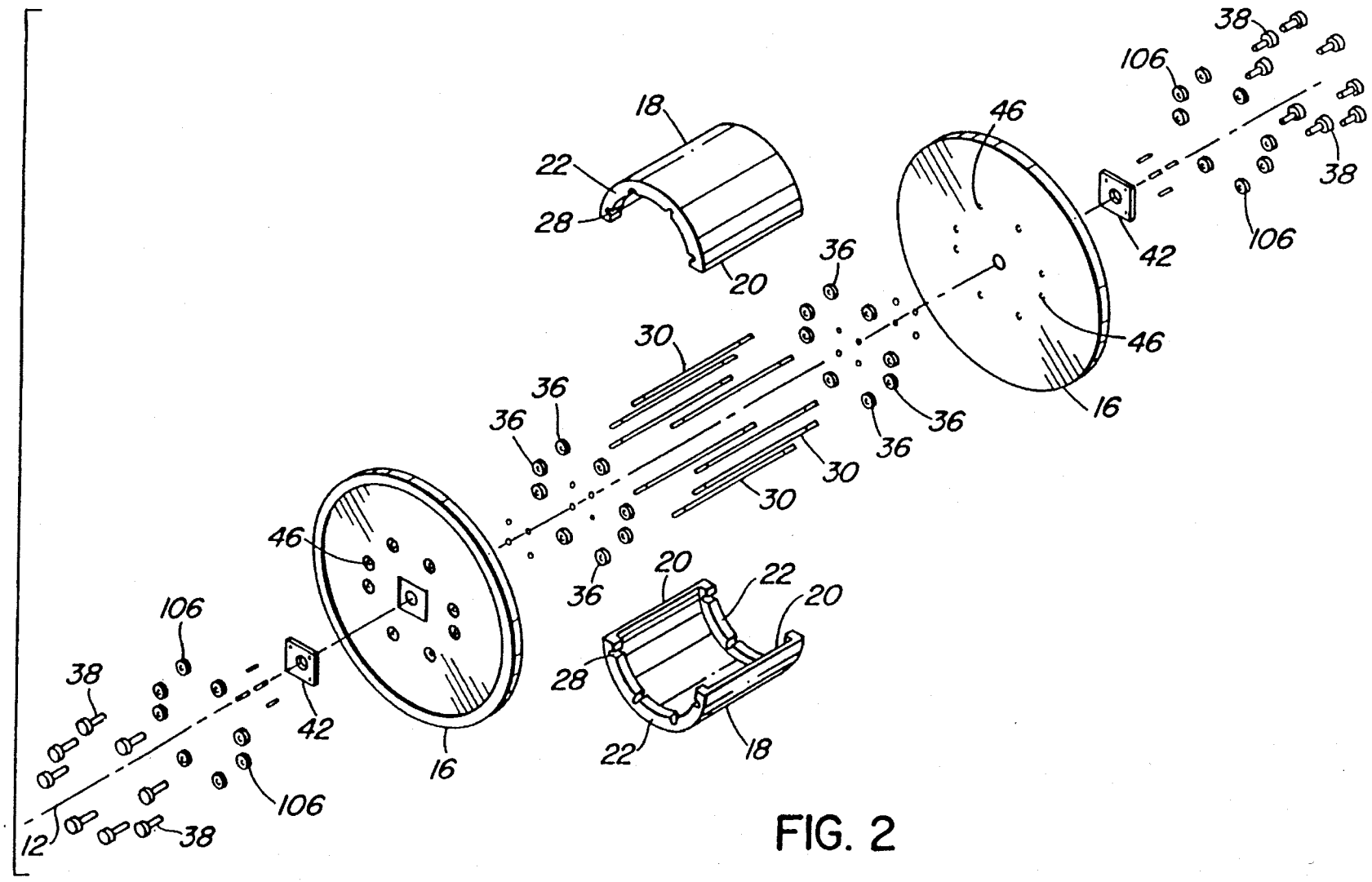
FIG. 2 is an exploded perspective view of the cable reel of FIG. 1.
Figure 3:
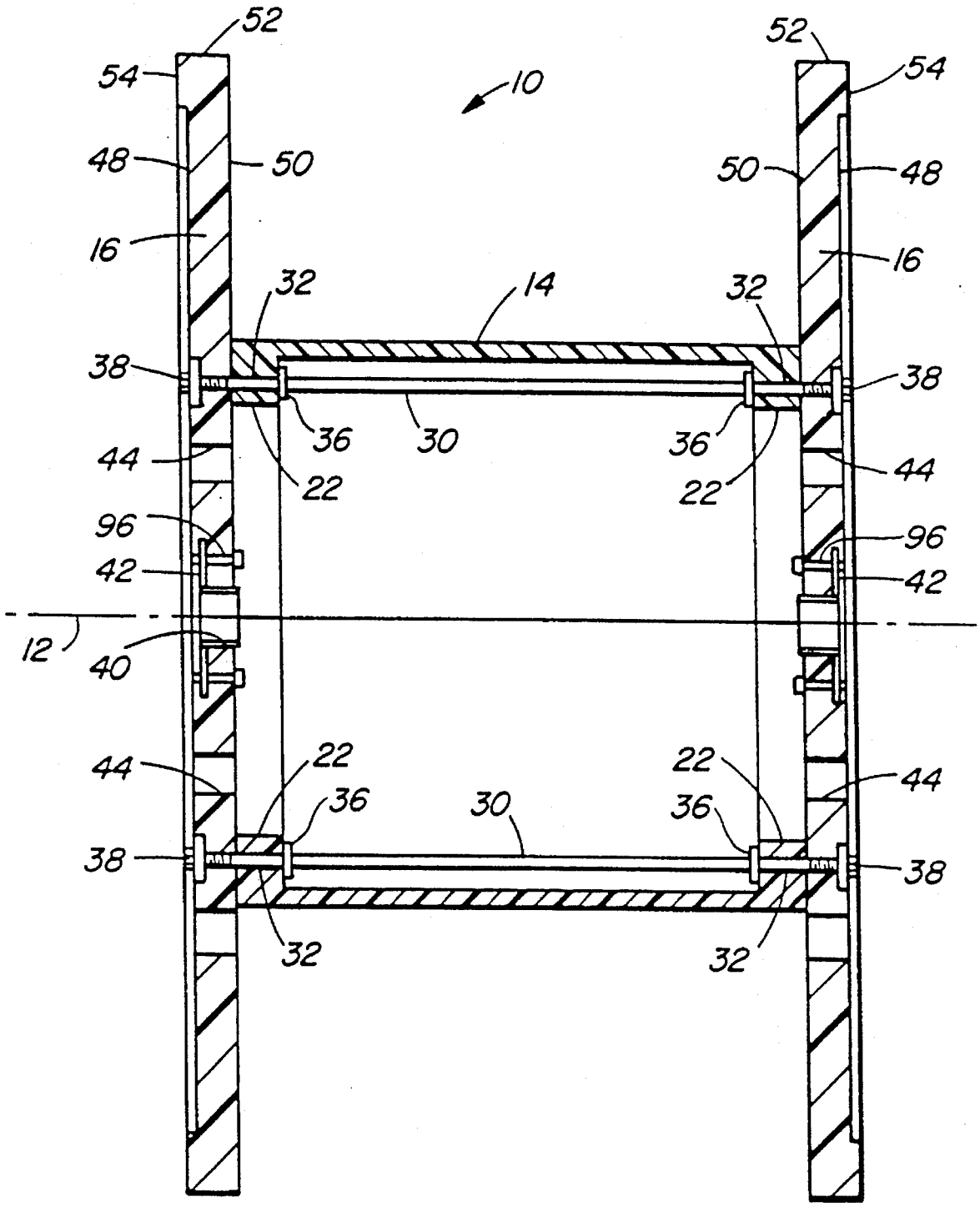
FIG. 3 is a cross-section view of the cable reel of FIG. 1 as seen along a plane through the central longitudinal axis of the reel.

With reference to FIGS. 1–3 of the drawings, there is shown a cable reel 10 in accordance with the invention having a central longitudinal axis of rotation 12. The reel 10 basically comprises a hollow, generally cylindrical centre drum 14 and a pair of substantially identical circular side flanges 16 detachably secured to the drum. The drum 14 and side flanges 16 are plastic components molded in accordance with a technique to be described below. The centre drum 14 is divided into two substantially identical half sections 18 but it will be evident that the drum 14 may be subdivided into three or even more sections. The sections 18 include parallel, longitudinally extending planar surfaces 20 which are in abutting relationship in the assembled configuration of the reel 10.

Each drum section 18 includes at each end thereof an inwardly directed end flange 22 which, in the assembled configuration of the reel 10, is radially oriented, that is, lies generally in a plane perpendicular to the axis 12. Each end flange 22 has radially extending, inner and outer surfaces 24 and 26, respectively. Each end flange 22 has a plurality of longitudinally extending slots 28, preferably four in number, equally spaced along the inner periphery of the end flange and in axial alignment with corresponding slots 28 formed in the opposite end flange 22.

Figure 7:
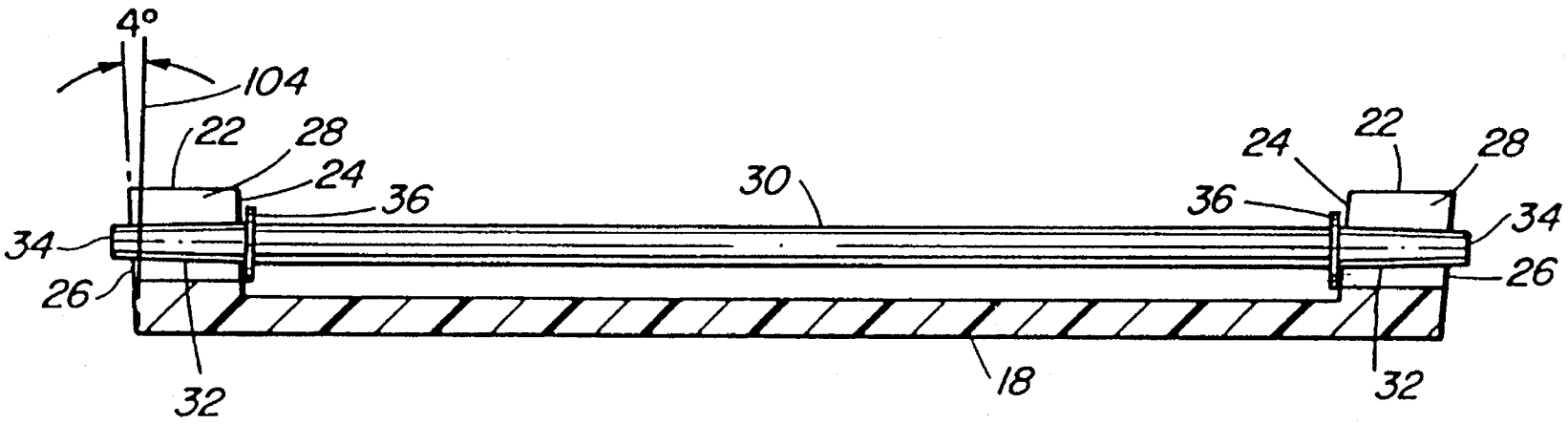
FIG. 7 is a view similar to that of FIG. 6 showing the configuration of the drum section following installation of tie rods.

Inserted in each pair of corresponding, axially aligned slots 28 is a longitudinally extending tubular tie rod 30; thus, four tubular steel tie rods are associated with each drum section 18. Each tie rod 30 includes tapered end portions 32 and extremities 34. Each tapered end portion 32 is bounded by a washer 36 welded or otherwise secured to the tie rod (FIG. 7). Each washer 36 is in contact with and presses against the inner surface 24 of the corresponding drum end flange 22. Instead of the washers 36, each tubular tie rod 30 may have formed integrally therewith, by a forging or upsetting process, an annular projection serving the same function as the washers 36 which function will be described in greater detail below.

As best seen in FIG. 7, the tie rod extremities 34 project from the outer surface 26 of the drum end flange. The tie rod end portions 32 are internally threaded to receive bolts 38 which secure the side flanges 16 to the drum sections 18 and, as will be described in greater detail below, which prestress the components of the final reel structure.

Each side flange 16 includes a hole 40, reinforced by a bushing or arbour plate 42, centred on the axis 12, for receiving a spindle or axle (not shown) for rotatably supporting the reel 10 while cable is unwound therefrom. A pair of holes 44 positioned along a diameter of the side flange 16 is adapted to receive reel drive pins (not shown) in a manner well known in the art. In addition, each side flange 16 includes a circular array of bolt holes 46 alignable with the slots 20 in the corresponding end flange 22 of the drum sections 18. The bolts 38 are passed through the bolt holes 46 and are received by the threaded bores in the end portions 32 of the tie rods 30 to secure the side flange 16 to the centre drum sections which are, as a result, held in abutting relationship.

Each side flange 16 also includes an outer face 48, an inner face 50 and a periphery 52. An annular lip 54 projects from the outer face of the side flange adjacent the periphery thereof; this lip serves an important function in the process of molding the side flange as will be described.

The solid plastic side flanges 16 may have a diameter of 6 feet or greater while the diameter and traverse of the associated drum 14 may be dimensioned as required consistent with the product to be carried and the load capacity. Drum diameters ranging upwardly from about 4 feet and traverses of 3 feet and greater may be utilized.

The reels of the present invention are fabricated using a unique molding process and the components thereof are prestressed during molding and assembly of the reel so as to permit the construction of large reels capable of carrying very high loads, for example, 10,000 pounds and even higher, without significant distortion, and having superior strength to handle substantial abuse.

Figure 4:
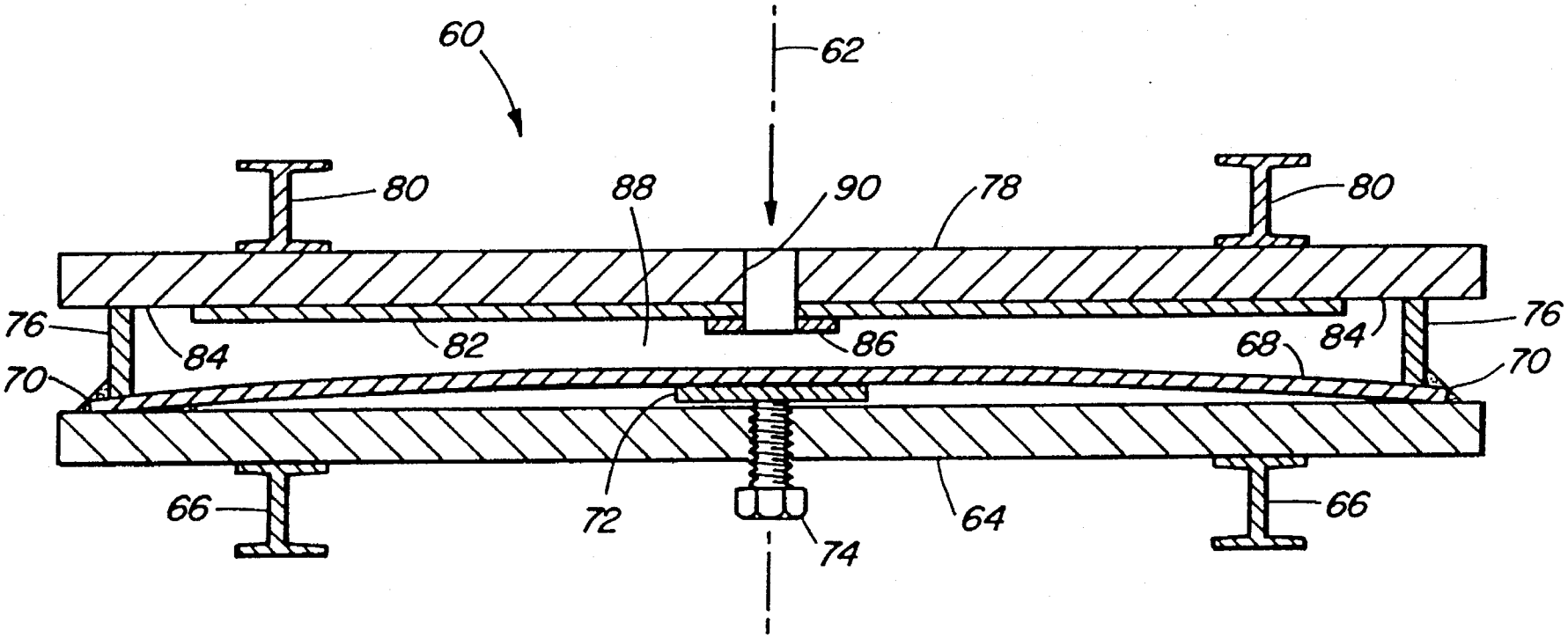
FIG. 4 is a side elevation view, in cross section, of a mold which may be used to form a side flange for reels in accordance with the invention.

With reference now to FIG. 4, there is shown a mold 60 for fabricating the side flanges 16 in accordance with the invention. The mold 60 has a central axis 62 and includes a rigid steel base 64 having a thickness of 1 inch, for example, supported and stiffened by I-beams 66. An adjustable, convex, circular steel plate 68 having a thickness of ¼-inch, for example, is disposed on the upper surface of the base 64. The periphery 70 of the convex plate 68 is welded to the upper surface of the base 64. Interposed between the convex plate 68 and the upper surface of the base is a small circular steel plate 72 having a thickness, for example, of ¼-inch, that may be urged upwardly by an adjusting bolt 74 threadedly received by the base 64 along the axis 62. It will be seen that the degree of curvature of the convex plate 68 may therefore be controlled by adjusting the bolt 74 which causes the plate 72 to move up or down. The convex plate 68 defines the inner surface of the reel side flange 16. Welded to the upper surface of the convex, circular plate 68 adjacent the outer edge thereof is an upstanding cylindrical ring 76, concentric with the axis 62 and which defines the outer periphery of the reel side flange. In accordance with one example of the invention, the cylindrical ring may have a height of 2½-inches and a diameter of 74 inches. Given the shrinkage that occurs during curing of the plastic, such a mold will yield flanges about 72 inches in diameter.

A mold cover 78 comprising, for example, a 1-inch steel plate, is carried by the upper edge of the ring 76 in the closed configuration of the mold. The cover 78 may include I-beams 80 secured to the upper surface of the cover for stiffening the cover and supporting it when it is removed from the lower portion of the mold. Welded to the inner or lower surface of the plate cover 80 is a circular plate 82, ¼-inch thick, for example, which has a diameter smaller than that of the ring 76 so as to form with the ring an annular recess 84 for defining the lip 54 on the outer face 48 of the reel side flange 16. A small, square plate 86 centred on the axis 62 is welded to the inner face of the circular plate 82 for defining a square recess in the outer surface of the reel side flange 16 for receiving the arbour plate 42. The convex plate 68, the ring 76, the recess 84 and the plates 82 and 86 define a mold cavity 88. A central inlet opening 90 extending through the cover 78 and plates 82 and 86 is provided for the introduction of plastic into the mold cavity 88.

In accordance with one example of the molding technique of the invention, a mixture of high density and low density polyethylene at 380° F. is introduced by extrusion molding apparatus (not shown) into the mold cavity 88 via a gate (not shown) and the inlet opening 90 and pressurized to about 8,000 psi. The pressure on the plastic in the mold cavity 88 causes a slight outward bowing of the cover plate 78 so that its inner surface assumes a slightly concave configuration.

When the plastic in the mold cavity 88 reaches the required pressure, the introduction of plastic via the inlet 90 is terminated and the mold 60 is transferred to and submerged in a water tank where it remains, in accordance with the example under consideration, for about 1½ hours. (Smaller flanges require less curing time; for example, a 48 inch flange is water cooled for about 45 minutes.) During that time initial curing of the plastic takes place. As is known, such curing is typically accompanied by shrinkage of the molded part. In accordance with another aspect of the invention, however, such shrinkage, especially shrinkage in the radial direction, is resisted by the peripheral lip 54 which is trapped in the annular recess 84 of the mold cavity 88. Hence, as the plastic cools and tries to shrink but cannot do so because of the trapped peripheral lip 54, the shrinkage forces are transferred into the material as prestressed tension which imparts toughness and stiffness to the reel side flange 16. This process, akin to "work hardening", increases the tensile strength and rigidity of the final reel side flange.

Figure 8:
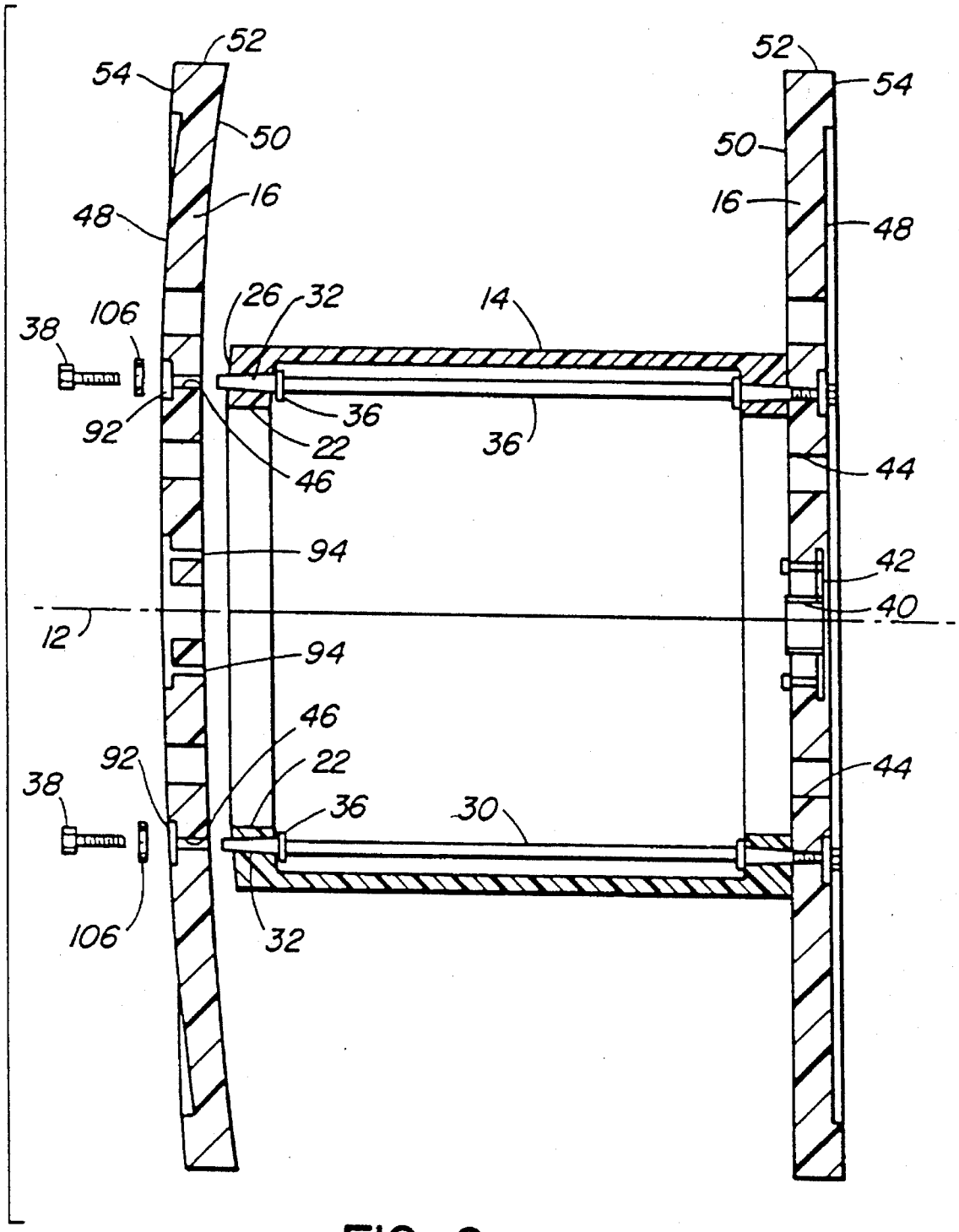
FIG. 8 is a cross-section of the cable reel of FIGS. 1–3 as seen along a plane passing through the central longitudinal axis of the reel showing one of the side flanges attached to the reel drum and the other side flange just prior to its attachment.

After about 1½ hours in the cooling tank, the mold 60 is removed, opened and the partially cured reel flange 16 is removed. The reel side flange is then allowed to cure further for about 24 hours. The reel side flange at this stage has a cross-sectional configuration that is slightly dished, as best seen in FIG. 8. As shown in that Figure, the inner face 50 of the left hand side flange 16 has a slightly concave curvature and the outer face 48 has a slightly convex curvature. The centre portion of the reel flange may be slightly thinner than the periphery as the curvatures of the inner and outer faces of the side flange may not precisely match.

The bolt holes 46, bolt hole counterbores 92, drive holes 44 and holes 94 for receiving arbour plate fastening bolts 96 are then drilled and the side flange 16 is ready for final assembly.

Figure 5:
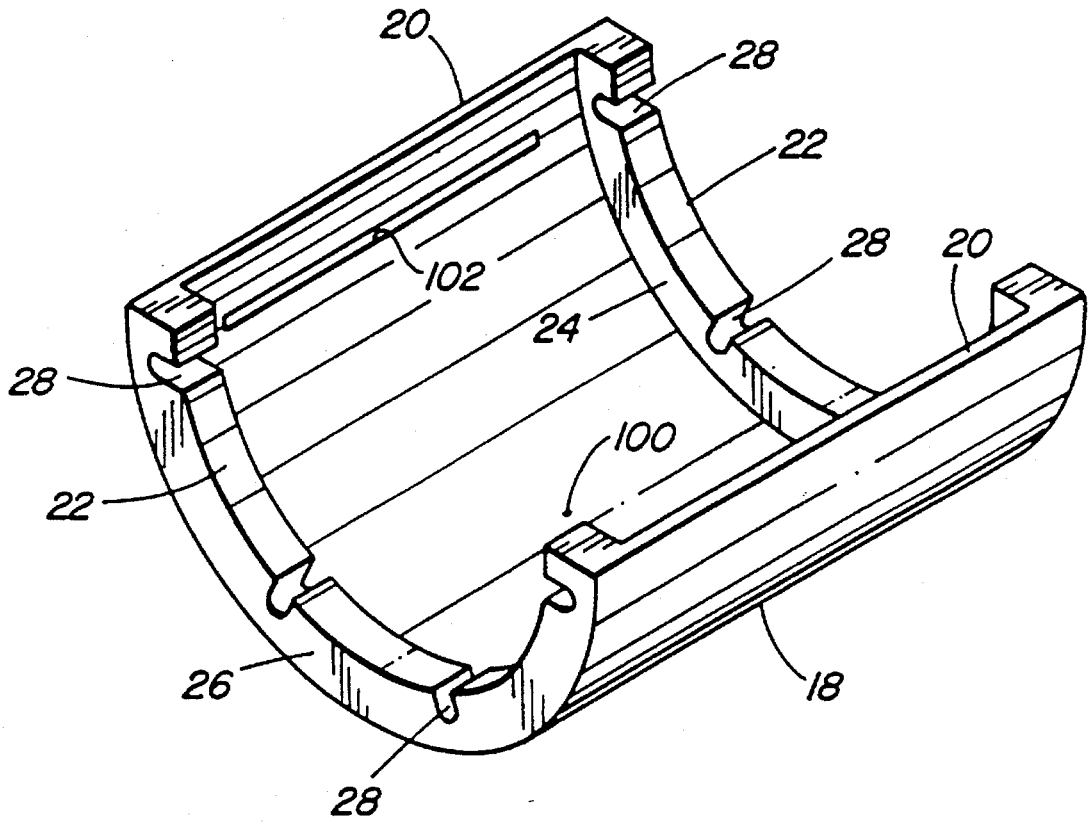
FIG. 5 is a perspective view of a section of a drum for use in a reel in accordance with the present invention.

The drum sections 18 may be formed in a fashion similar to that used to form the side flanges 16. A mixture of high density and low density polyethylene is introduced at 380° F. into an appropriately shaped mold cavity and pressurized to about 8,000 psi. The plastic is preferably introduced along the inner surface of the drum section 18 at a central point 100 (FIG. 5), that is, at a point midway between the end flanges 22 in a longitudinal direction and midway between the longitudinal mating surfaces 20 in the circumferential direction. The inlet to the mold is then closed and the mold is submerged in a cooling tank for about 30 minutes, allowing initial curing of the molded part to take place. The mold is then removed from the cooling tank and opened and the plastic drum section 18 is removed from the mold cavity and allowed to cure for about 24 hours. During the initial curing of the drum section 18 while it is still in the mold, shrinkage is resisted in the axial or longitudinal direction by the end flanges 22 and in the circumferential direction by means of axially extending embossments having semi-circular cross sections projecting from the inner mold wall adjacent the longitudinal edge surfaces.

These embossments tend to grip the molded part and restrain circumferential shrinkage while the end flanges serve the same function in the axial direction. The embossments on the mold wall form corresponding elongated indentations 102 in the final part. As in the case of the reel side flanges 16, the resistance to shrinkage provided by the end flanges 22 and the embossments increases the strength and rigidity of the drum sections 18.

Figure 6:
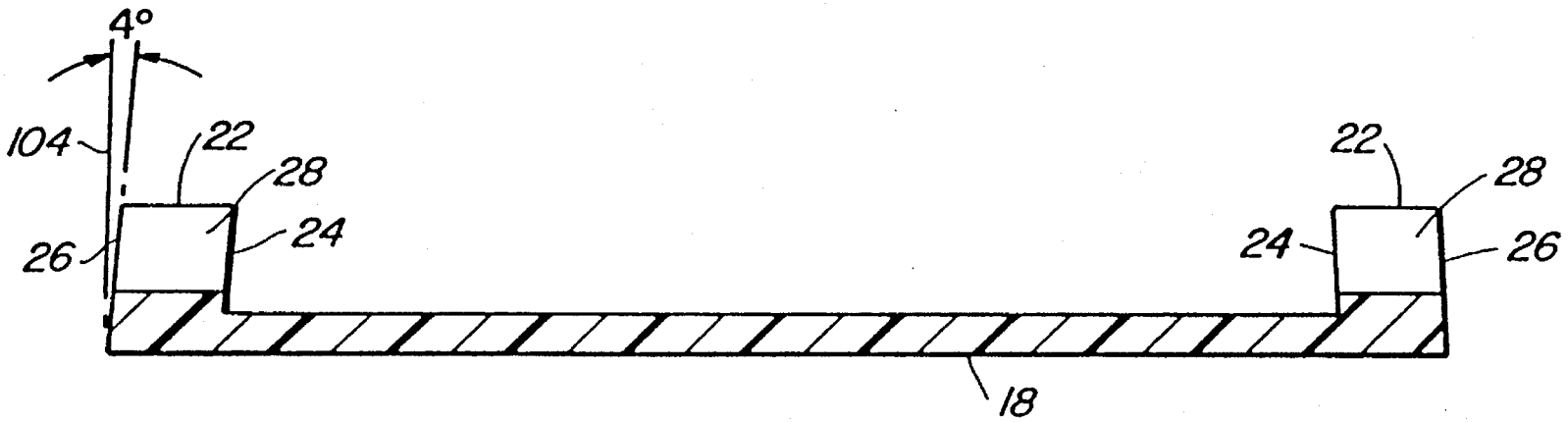
FIG. 6 is a cross-section of the drum section of FIG. 5 showing its configuration following molding but before installation of tie rods.

With reference to FIG. 6, the drum section mold cavity is so configured that the end flanges 22 of each drum section 18 are tipped inwardly, that is, toward each other so that, pursuant to one practical example of the invention, the inner and outer radial surfaces 24 and 26 of each end flange 22 are disposed at an angle of about 4° relative to a plane 104 (FIG. 6) perpendicular to the longitudinal axis of the drum.

The longitudinally extending slots 28 in the end flanges 22 of the drum sections 18 may be conveniently formed as part of the molding operation so that after curing of the drum section 18, the tie rods 30 may be installed without the need for any secondary slot-forming operations. Importantly, each drum section 18 is molded so that the axial distance between the opposed, inner surfaces 24 of the end flanges 22 is shorter than the distance between the washers 36 welded to the tie rods 30. When the drum section 18 is substantially completely cured, that is, after the 24 hour curing time, a hydraulic ram (not shown) is inserted between the inner surfaces 24 of the opposed end flanges 22 and the end flanges are urged outwardly thereby. As a result, the end flanges assume the configuration shown in FIG. 7 in which configuration they are directed outwardly or away from each other at an angle of about 4°, for example, relative to the plane 104. The longitudinal tie rods 30 are then inserted in the slots 28, also as shown in FIG. 7. When the force exerted by the hydraulic ram is relieved, the inner surfaces 24 of the end flanges 22 bear against the washers 36. The washers 36 resist further shrinkage during the final curing stage of the drum section 18, transferring tension to the plastic thereby strengthening the material in the longitudinal direction. The steel tie rods also thereby provide reinforcing, substantially increasing the strength and rigidity of the drum sections. The reel side flanges 16 and drum sections 18 are now ready for final assembly.

The drum sections 18 are brought together at their longitudinal mating surfaces 20 and, with the projecting extremities 34 of the tie rods 30 in alignment with the corresponding bolt holes 46 in the side flanges 16, the inner faces 50 of the reel side flanges are brought into contact with the outer surfaces 26 of the drum section end flanges 22. Washers 106 are positioned in the bolt hole counterbores 92 and the bolts 38 are inserted into the threaded end portions of the tie rods 30. Tightening of the bolts 38 with sufficient force draws the centre portion of the dished reel flange 16 inwardly tending to flatten the side flange and to align it substantially with a plane perpendicular to the longitudinal axis. This process imparts tension and further prestresses the flange. This prestress helps resist outward bending of the flange under the forces applied by cable wound on the reel. The work hardened and prestressed reel components make possible the construction of very large plastic cable reels with sufficient strength and rigidity to allow storage with a full load of 10,000 pounds or more for an extended period with minimum distortion and no flattening.

Figure 9:
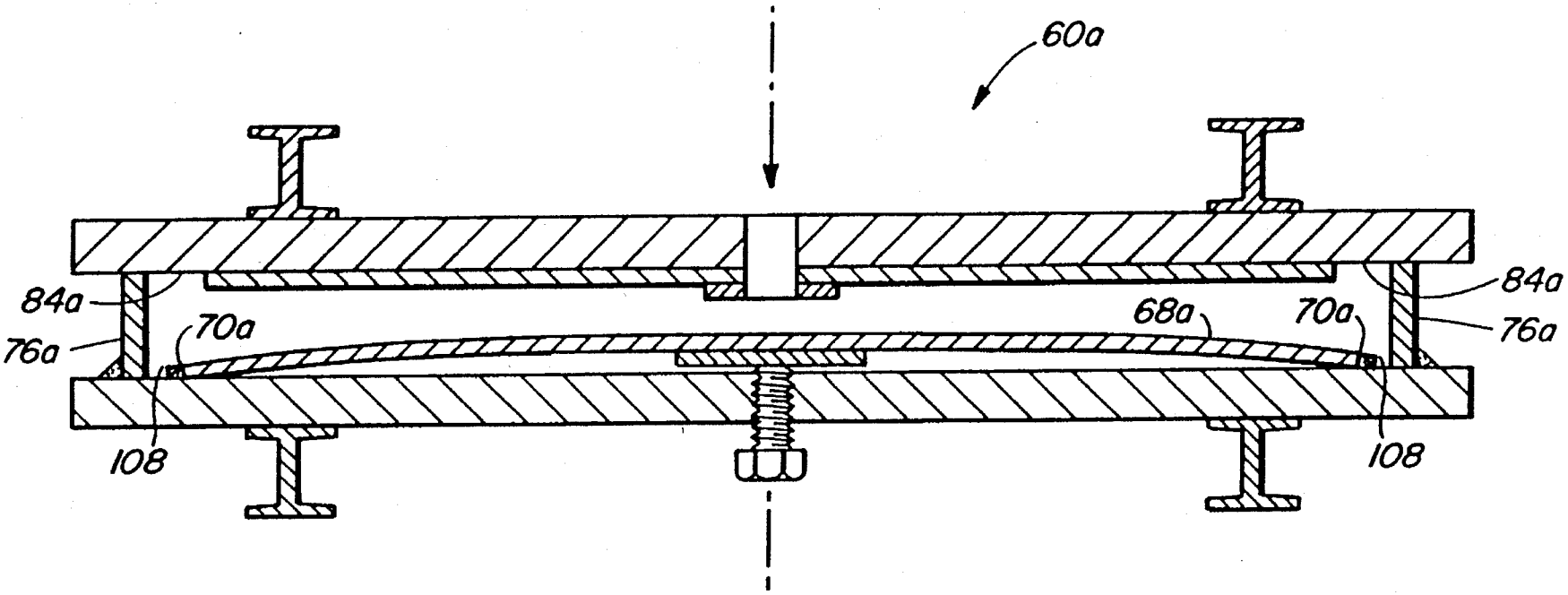
FIG. 9 is a side elevation view, in cross section, of a mold which may be used to form a side flange in accordance with a second embodiment of the invention.
Figure 10:
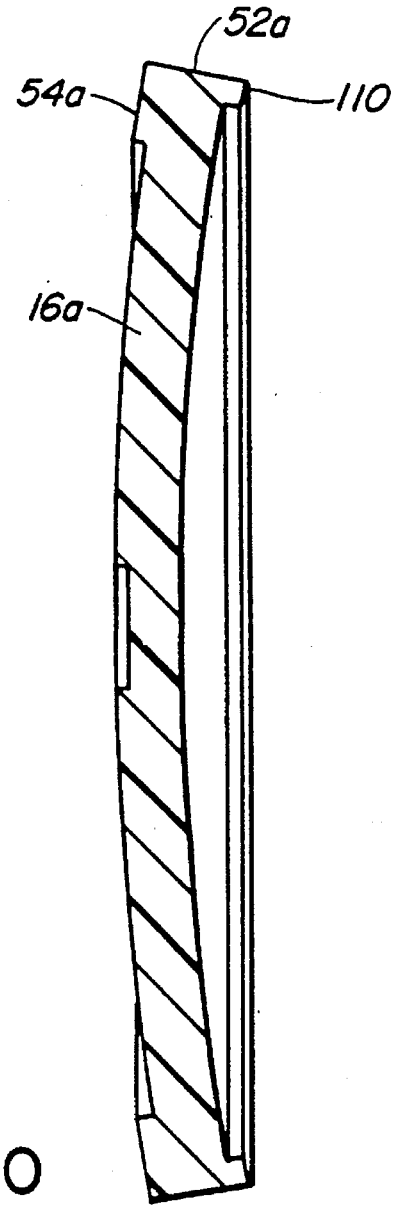
FIG. 10 is a cross section view of the peripheral portion of a side flange, in accordance with the second embodiment, formed in the mold shown in FIG. 9.

FIG. 9 shows a mold **60*a* for fabricating a reel side flange 16*a* (FIG. 10) in accordance with an alternative embodiment of the invention. The mold 60*a* includes a circular, convex plate 68*a* having a diameter somewhat smaller than the ring 76*a* so that the outer periphery 70*a* of the plate 68*a* and the ring 76*a* define between them a small annular recess 108 lying opposite the annular recess 84*a*. As before, the plastic entering the recess 84*a* defines a peripheral lip 54*a* on the outer face of the reel side flange 16*a*. The opposite recess 108 forms a peripheral lip 110 on the inner face of the final side flange 16*a*. The lip 110 has the same function as the lip 54*a*, gripping the periphery of the side flange 16*a* during curing so as to resist dimensional shrinkage and thereby prestressing and "work hardening" the material. With lips on both faces of the side flange, the peripheral surface 52*a* of the final side flange 16*a* retains a substantially cylindrical shape. Without the lip 110, the final peripheral surface of the reel side flange tends to assume a generally conical shape, with the diameter of the inner face of the side flange being somewhat smaller than that of the outer face. Lip 110** is removed by cutting after the plastic material has cooled down following moulding.

Figure 11:
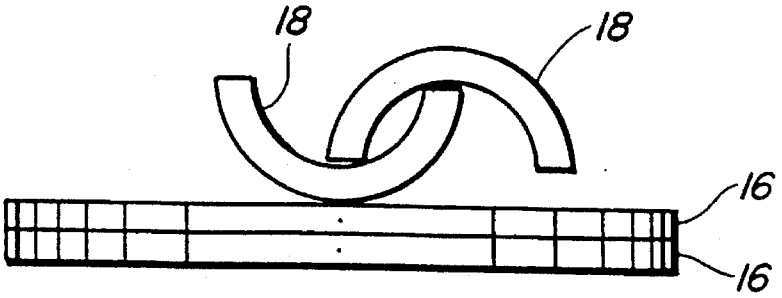
FIG. 11 is a schematic, side elevation view of the parts of a knocked down reel in accordance with the present invention as they might be stacked for storage or shipment.
Figure 12:
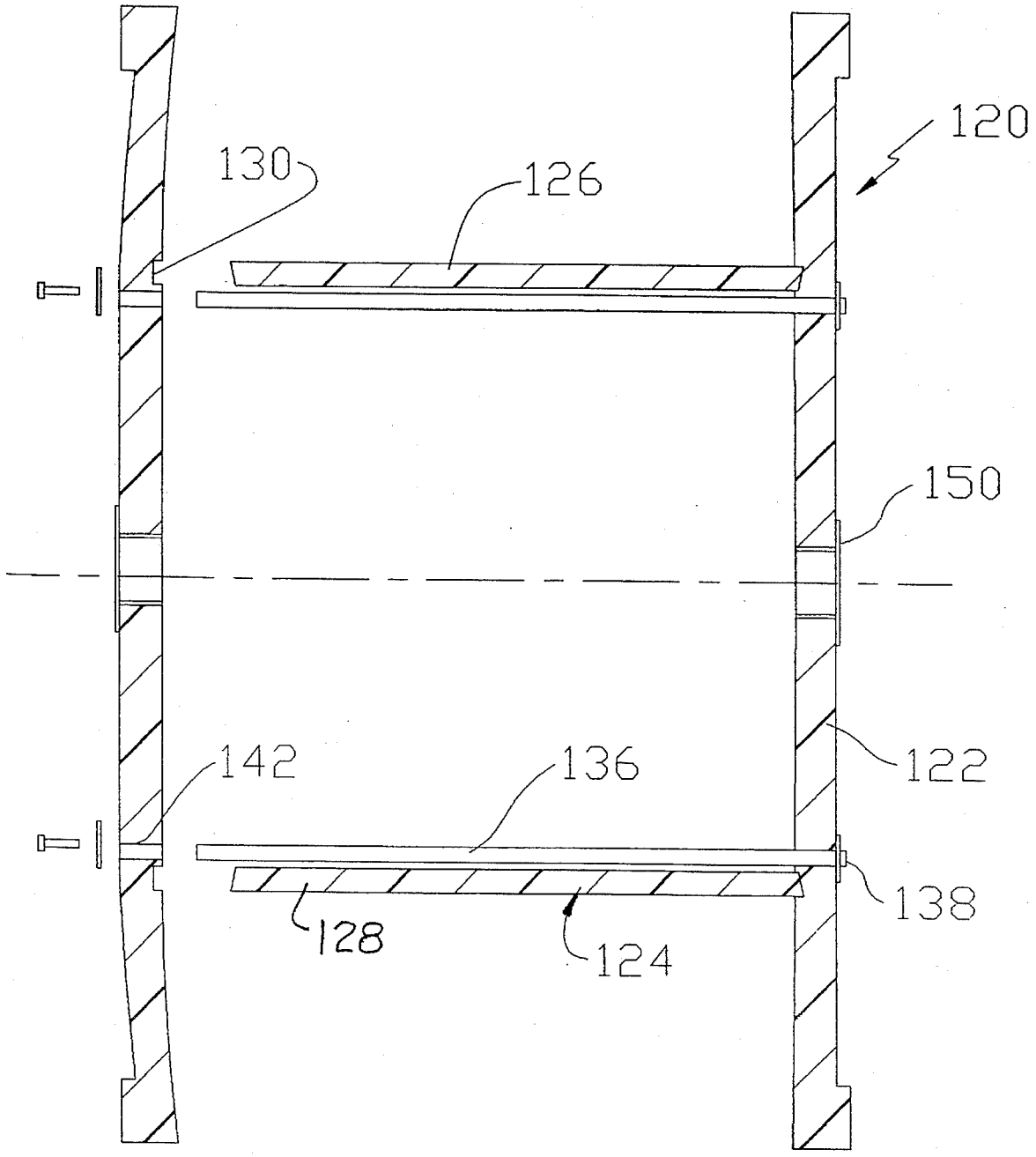
FIG. 12 is a cross-section of a third embodiment of a cable reel as seen in a plane passing through the central longitudinal axis of the reel, one of the side flanges shown as being attached to the reel drum and the other side flange shown just prior to its attachment.
Figure 13:
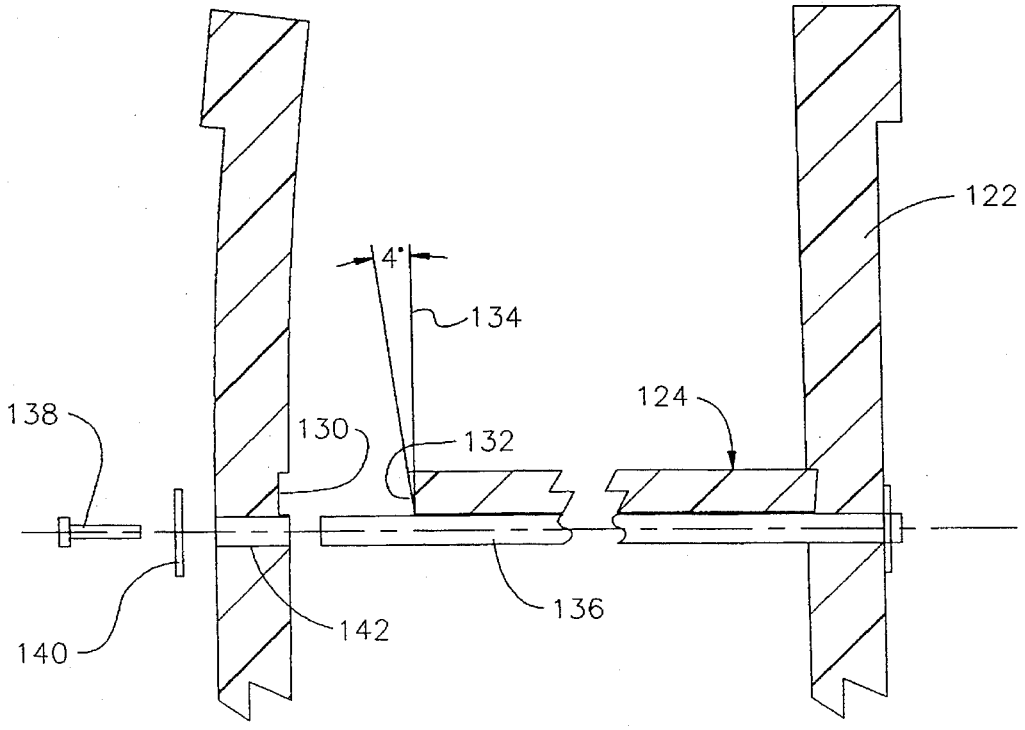
FIG. 13 is an enlarged view of the upper portions of FIG. 12 showing certain structural details.

The reel may be easily disassembled by removing the bolts 36 for storage and shipment of the reel components as a compact package. FIG. 11 shows one stacking arrangement of the principal, knocked down reel components comprising the reel side flanges 16 and drum sections 18.

With reference to the embodiment of FIGS. 12–17 there is shown a simplified reel 120 having the advantages of the reels described above, reel 120 including a pair of opposed reel side flanges 122 and a drum 124 comprising a pair of half drum sections 126, 128.

The side flanges 122 are moulded in essentially the same way as previously described to provide the prestressing described above (with the embodiment of FIG. 10 being preferred), the main exception being that the mold **60*a* is provided with a ring (not shown) concentric with and fixed to convex plate 68*a*. This ring has a diameter and cross-sectional shape chosen to provide the convex inner face of each side flange 122 with a circular groove 130 which receives the ends of the drum sections and holds the drum sections 126, 128 in place, thus ensuring that the drum 124 is round and concentric with the central longitudinal axis of the reel 120**.

The drum half sections 126, 128 are made in a manner similar to that described previously except that since no drum end flanges are provided, prestressing in the longitudinal direction requires a slightly different procedure.

Figure 15:
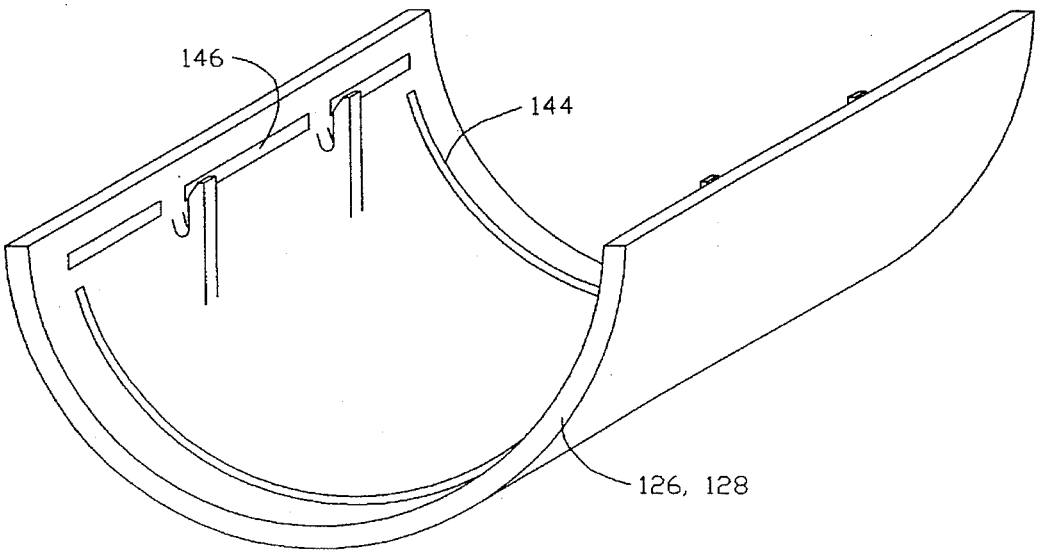
FIGS. 15, 16 and 17 are perspective, top and end views respectively of a drum half section of the third embodiment of the invention.
Figure 16:
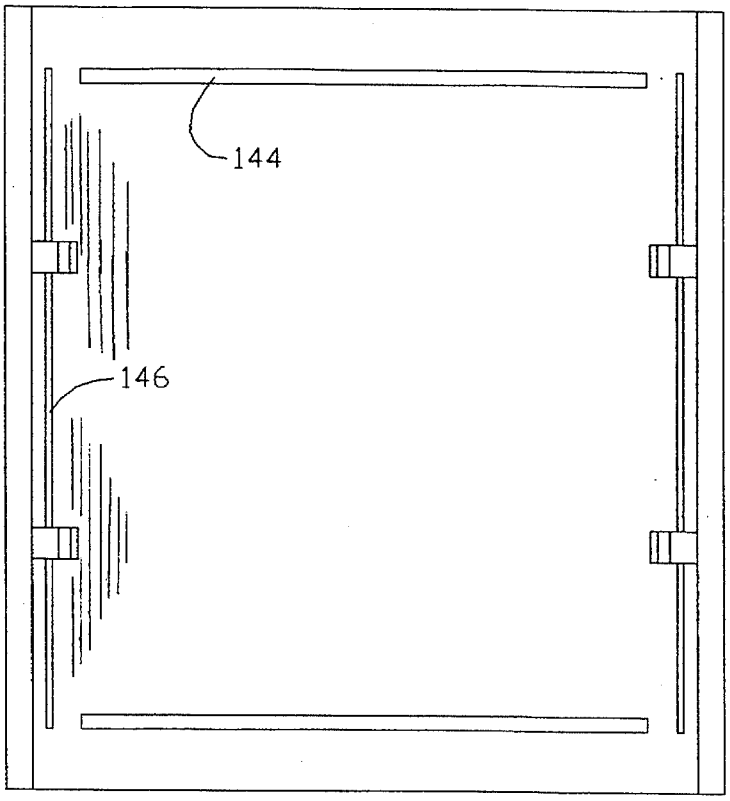
Figure 17:
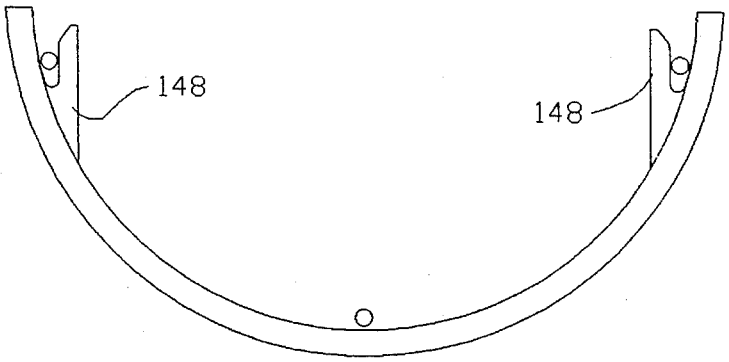

With reference to FIGS. 15–17, the drum half sections 126,128 are formed in a mold having axially extending hold bars as before projecting from the inner mold wall adjacent the longitudinal edge surfaces of the half sections. Similarly, circumferentially extending hold bars are located near the ends of the mold wall half sections. These hold bars leave the impressions 144,146 on the inside of the drum sections 126,128 (FIGS. 15, 16). During molding, as the plastic shrinks during curing and hardening, the above-noted hold bars restrain the shrinkage thus setting up longitudinal and circumferential prestresses in the plastic material thus providing for stronger drum sections. The drum halves are also provided with internal lugs 148 for holding the rods 136 in position especially during assembly (see FIGS. 15–17).

The drum half-sections may, in fact, be molded in relatively long lengths and then cut to the desired length, thus permitting the same mold to be used for several lengths of reel. The ends of the drum half-sections are cut or formed such that their radial end surfaces 132 are tipped radially inwardly at a small angle (e.g. about 4°) to a plane 134 normal to the longitudinal axis of the drum (see FIG. 13).

The reel is assembled together using a plurality of circumferentially spaced tie rods 136, the opposing ends of same being internally threaded to receive threaded bolts 138, each having a large washer 140 which bears against the outer face of the drum side flange. The tie rods extend through corresponding drilled holes 142 in the side flanges 122.

In the course of reel assembly, the opposing side flanges 122 are positioned at opposing ends of the drum half sections with their opposed concave and convex faces facing inwardly and outwardly respectively (FIGS. 12 and 13), the tie rods 136 being properly located and positioned, following which the bolts 138 are tightened. The opposing ends of the drum sections 126, 128 are thus brought into engagement with the flat bottoms of the grooves 130. Initially only the outer circumferential edges of the drum end surfaces 132 contact the groove bottoms owing to the radially inwardly tipped shapes of these end surfaces 132 as described above. Hence, as the bolts 138 are tightened and the center portions of the dished reel side flanges 122 are drawn axially inwardly, a torque is applied to both side flanges 122 which tends to flatten the same and draw them into planes perpendicular to the reel central longitudinal axis. As with the previous embodiments, this flattening action adds further stress to the side flanges thus giving rise to the beneficial results described previously.

Figure 14:
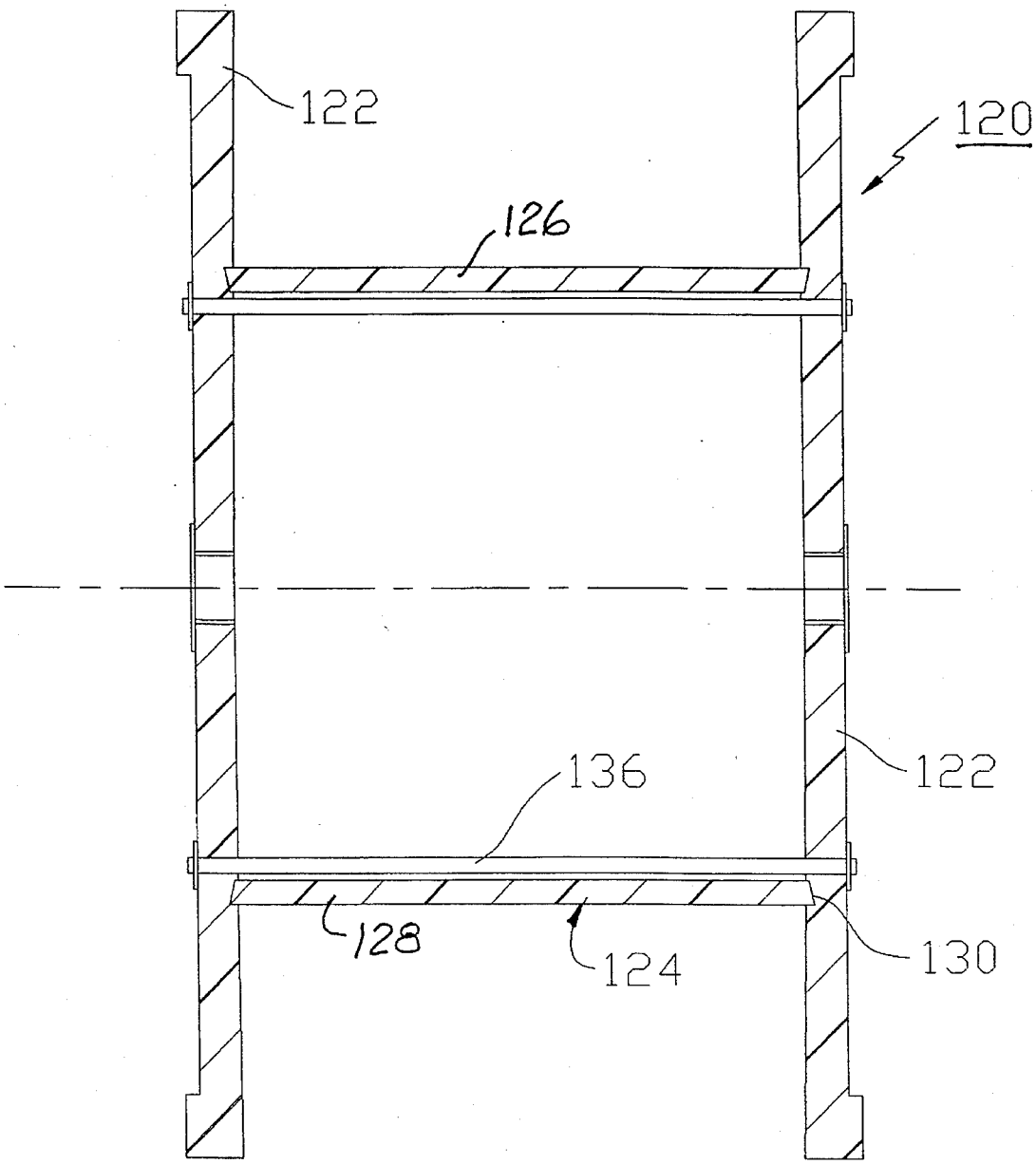
FIG. 14 is a view similar to that of FIG. 12 but showing the reel in the fully assembled condition.

The fully completed reel 120 is shown in FIG. 14. The pre-stressed flat side flanges 122 with their central metal arbour fittings 150 are held firmly in position against opposing ends of the prestressed drum 124 and the drum is held securely in the opposing grooves 130 thus ensuring that the drum shape is maintained. The tie rods 136, being radially inwardly of the drum 124, provide additional support to the drum under heavy loads.

The reel components can be fabricated from recycled plastic materials and is therefore very economical. The use of such recycled material in another context, highway crash barrier posts, is disclosed in U.S. Pat. No. 5,219,241 issued to the present inventor on Jun. 15, 1993.

In one example, a typical mix of plastics is 70% linear low density polyethylene, 20% high density polyethylene and the balance polypropylene, all of these materials being from recycled stocks. A mixture of substantially equal parts of high density and linear low density polyethylene is also feasible, although higher percentages of high density polyethylene tend to produce a more brittle and hence less impact resistant product. Also, various mixtures produce different surface finishes; higher percentages of linear low density polyethylene, for example, yield smoother finishes.

Low density polyethylene would also be suitable. 100% low density polyethylene may be used provided it is of the right grade such as film grade or pipe grade. Injection molding grade would usually not be suitable as its impact resistance is low. Usually it would be beneficial to add about 20% high density polyethylene to the low density grade.

What is claimed is:

1. A high strength plastic cable reel capable of carrying heavy loads, the reel having a central longitudinal axis and comprising: a plastic drum having opposite axial ends, a prestressed plastic side flange at each said end of the drum, each side flange tending to assume a dished configuration and attachments securing each side flange to the corresponding end of the drum, the attachments serving to flatten each side flange in opposition to its tendency to assume said dished configuration.

2. A cable reel, as defined in claim 1, in which each side flange has an axially inner face and an axially outer face facing away from the drum, the inner face tending to assume a generally concave configuration and the outer face tending to assume a generally convex configuration.

3. The cable reel of claim 2 wherein each side flange has an annular groove on the inner face thereof which receives the corresponding end of the drum.

4. The cable reel of claim 3 wherein the attachments comprise a plurality of tie rods located within the drum and positioned parallel to the central axis, the ends of the tie rods being disposed in through holes in said side flanges, and fasteners on opposed ends of said tie rods and bearing against outer face portions of said side flanges.

5. The cable reel of claim 3 wherein said attachments are capable of being tightened to effect the flattening of the side flanges, each said drum end having a radial surface which is tipped radially inwardly by a small angle to facilitate the flattening of said side flanges as said attachments are tightened.

6. The cable reel of claim 5 wherein the attachments comprise a plurality of tie rods located within the drum and positioned parallel to the central axis, the ends of the tie rods being disposed in through holes in said side flanges, and fasteners capable of being tightened located on opposed ends of said tie rods and bearing against outer face portions of said side flanges.

7. A cable reel, as defined in claim 1, in which the drum comprises at least two sections separable along surfaces extending between the ends of the drum, the side flanges being detachably secured to the at least two drum sections to provide a knock-down reel.

8. A cable reel, as defined in claim 1, in which the drum and side flanges are fabricated of recycled plastic.

9. A cable reel, as defined in claim 8, in which the recycled plastic comprises a mixture of high density polyethylene and low density polyethylene derived from post-consumer plastic waste.

10. A cable reel, as defined in claim 1, in which said attachments flatten each said side flange sufficiently to bring same into correspondence with a plane substantially perpendicular to the central longitudinal axis.

11. A cable reel, as defined in claim 10, in which the drum includes a radially inwardly directed end flange at each end of the drum, each drum end flange having an outer, generally radially extending surface and an inner, generally radially extending surface, each of the end flanges including a plurality of axially extending slots, the slots in the end flange at one end of the drum being in axial alignment with corresponding slots in the end flange at the other end of the drum to define axially aligned pairs of slots; and wherein said attachments include a plurality of tie rods disposed within the drum and positioned parallel with the central longitudinal axis, each tie rod having end portions disposed within a corresponding pair of axially aligned slots, the rods further having outer extremities projecting into holes in the side flanges, the end portions of the tie rods having fasteners thereon capable of being tightened against outer face portions of said side flanges.

12. A cable reel, as defined in claim 11, in which each tie rod includes means for engaging the inner surfaces of the end flanges on the opposite ends of the drum, said inner surface engaging means tending to bend the end flanges outwardly.

* * * * *